US007654050B2

(12) United States Patent
Justice

(10) Patent No.: US 7,654,050 B2
(45) Date of Patent: Feb. 2, 2010

(54) CORNER TRIM PIECE FOR SIDING

(76) Inventor: Brett C Justice, 204 Crimson Trail, Tallmadge, OH (US) 44278

( * ) Notice: Subject to any disclaimer, the term of this patent is extended or adjusted under 35 U.S.C. 154(b) by 827 days.

(21) Appl. No.: 10/852,993

(22) Filed: May 25, 2004

(65) Prior Publication Data

US 2005/0262784 A1 Dec. 1, 2005

(51) Int. Cl.
*E04F 13/00* (2006.01)

(52) U.S. Cl. ..... 52/288.1; 52/287.1; 52/276; 52/546

(58) Field of Classification Search ..... 52/287.1, 52/288.1, 57, 198, 199, 276, 278, 543, 546, 52/212, 716.1
See application file for complete search history.

(56) References Cited

U.S. PATENT DOCUMENTS

| | | | | |
|---|---|---|---|---|
| 1,729,946 | A * | 10/1929 | Kuehn | 52/478 |
| 2,056,521 | A * | 10/1936 | Honan | 52/276 |
| 2,255,736 | A * | 9/1941 | Odell | 52/278 |
| 2,501,221 | A * | 3/1950 | Humble | 52/535 |
| 2,607,449 | A * | 8/1952 | Daniels | 52/553 |
| 2,616,131 | A * | 11/1952 | Gage | 52/276 |
| 3,500,600 | A | 3/1970 | Bagley, Sr. | |
| 3,651,610 | A | 3/1972 | Donahue | |
| 3,691,711 | A * | 9/1972 | Lowery | 52/282.3 |
| 3,828,499 | A * | 8/1974 | Leddy | 52/278 |
| 3,897,667 | A * | 8/1975 | Turek | 52/546 |
| 4,015,391 | A | 4/1977 | Epstein et al. | |
| 4,129,971 | A | 12/1978 | Reusser | |
| 4,189,885 | A | 2/1980 | Fritz | |
| 4,196,553 | A | 4/1980 | Veach | |
| 4,643,080 | A * | 2/1987 | Trostle et al. | 454/365 |
| 5,222,343 | A | 6/1993 | Anderson | |
| 5,347,784 | A | 9/1994 | Crick et al. | |
| 5,537,792 | A * | 7/1996 | Moliere | 52/531 |
| 5,542,222 | A | 8/1996 | Wilson et al. | |
| 5,664,376 | A | 9/1997 | Wilson et al. | |
| 5,694,728 | A | 12/1997 | Heath, Jr. et al. | |
| 5,836,123 | A | 11/1998 | Gulino | |
| 5,974,748 | A * | 11/1999 | Sciuga et al. | 52/287.1 |
| 6,311,442 | B1 | 11/2001 | Watanabe | |
| 6,341,458 | B1 | 1/2002 | Burt | |
| D454,648 | S | 3/2002 | Shaw et al. | |
| 6,405,503 | B1 * | 6/2002 | Reed | 52/288.1 |
| D472,333 | S | 3/2003 | Shaw | |
| 6,553,732 | B2 | 4/2003 | Shaw | |
| 6,631,600 | B2 * | 10/2003 | Schiedegger et al. | 52/658 |

(Continued)

*Primary Examiner*—Robert J Canfield
*Assistant Examiner*—Jessie Fonseca
(74) *Attorney, Agent, or Firm*—Baker & Daniels LLP

(57) ABSTRACT

A corner trim member for mounting on a wall surface in combination with decorative siding panels. The corner trim member includes a plurality of integrally formed decorative elements. The decorative elements define a front face of the corner trim member. The corner trim member may also include a top edge disposed above the decorative elements; a bottom end; a pair of side edges; and a longitudinally extending channel located adjacent each side edge for receiving a laterally disposed decorative siding panel. The longitudinally extending channels may be defined by a back surface of the side edges, an angled end wall extending from the back surfaces, and a mounting flange extending from the end walls. The angle between respective end walls and back surfaces may be an acute angle. The front face and the decorative elements may be mounted in alignment with a corner of the wall surface.

18 Claims, 8 Drawing Sheets

U.S. PATENT DOCUMENTS

2002/0121057 A1 9/2002 Steffes et al.
2002/0162291 A1 11/2002 Steffes et al.
2003/0037495 A1* 2/2003 Shaw ..... 52/287.1
2003/0226327 A1* 12/2003 Perry ..... 52/287.1

* cited by examiner

CORNER TRIM PIECE FOR SIDING

BACKGROUND OF THE INVENTION

The present invention relates to decorative exterior wall coverings, and in particular, to an injection molded corner trim piece having integrally formed elements to improve the appearance and fit of the corner trim pieces when attached together or to siding panels.

Many types of exterior panels are currently known and used in the construction and improvement of residential, commercial, industrial and other buildings. Typically, such panels are formed from a light-weight composite material and are manufactured using conventional extrusion molding, injection molding, impression molding or thermal forming processes. Such panels may be formed in various shapes, such as individually elongated sections similar to standard aluminum siding or single panels incorporating one or more rows of individual decorative elements, such as for example, simulated cedar shake siding. Individual panels are often connected to other previously installed, identical panels through a vertical attachment and a horizontal attachment by which portions of the panel to be installed overlap portions of previously installed panels.

A natural joint is formed between the panels at corners of the structures or buildings to which the panels are mounted. The corners may be covered with trim boards or other trim members to hide the corner joint. In the case of siding have simulated cedar shake elements, it is aesthetically desirable to cover the corner joints with trim pieces that match the simulated cedar shake elements. One such corner trim piece is disclosed in U.S. Pat. No. 4,015,391 to Epstein et al. entitled SIMULATED CEDAR SHAKE CONSTRUCTION, issued Apr. 5, 1977, which is incorporated in its entirety herein by reference. Epstein et al. discloses single row simulated cedar shake corner trim piece elements. The corner trim piece elements have no side joints or connections and are designed merely to overlap horizontally adjacent siding panels. The trim piece elements do include a vertical lip upstanding on the bottom inside edge and an extension tab extending from the top edge having a nose-like member projection forward from the planes of the shake faces. A slot receptor is formed between the base of the nose and the extension tab that is configured to receive the vertical lip on a corner trim piece member to be mounted directly above.

Another simulated cedar shake corner trim piece is disclosed in U.S. Pat. No. 5,347,784 to Crick et al. entitled DECORATIVE WALL COVERING WITH IMPROVED INTERLOCK AND CORNER CONSTRUCTION issued Sep. 20, 1994, which is incorporated in its entirety herein by reference. The corner trim piece disclosed by Crick et al. has three tiers of simulated cedar shake elements. Along the sides of the corner trim pieces an outwardly opening pocket is formed for receiving an end of a respective panel mounted horizontally adjacent the trim piece. The corner trim piece disclosed by Crick et al. also includes upwardly extending notches at the lower end thereof, which are intended to permit positioning of the lower end of the corner trim piece over a previously mounted corner molding. The corner trim pieces also include small horizontal locating ledges at the upper end that are intended to facilitate proper positioning of the notches of a corner trim piece onto a previously mounted trim piece.

Another simulated cedar shake corner trim piece is disclosed in related U.S. Publication Nos. US 2002/0121057 A1, published Sep. 5, 2002 and US 2002/0162291 A1, published Nov. 7, 2002, both to Steffes et al. and entitled CEDAR IMPRESSION SIDING CORNER. The design of this simulated cedar shake trim piece is also disclosed in U.S. Design Pat. No. D454,648 S to Shaw et al. entitled CEDAR IMPRESSION OUTSIDE SIDING CORNER, issued Mar. 19, 2002, and all of those are incorporated in their entirety herein by reference. The simulated cedar shake corner piece disclosed by Steffes et al. and Shaw et al. is formed with two offset tiers of simulated cedar shake elements. The elements do not have any grooves or attachment joints along the side edges; however, the side edges of the upper simulated cedar shake element are laterally offset from the side edges of the lower simulated cedar shake element. The corner trim piece disclosed by Steffes et al. and Shaw et al. also includes catches disposed at the inner bottom end and nailing flanges extending vertically upward from the top end of each trim piece. The nailing flanges also include catches that extend downward from the front sides of the trim pieces. The catches disposed at the bottom end of one corner trim piece fit into the catches disposed on the nailing flanges of a corner trim piece that is mounted below.

There continues to be a need for corner trim elements that have an improved aesthetic appearance and locking configuration to lock with other corner trim elements above and below and to join with laterally disposed siding panels. It is therefore, an object of the present invention to provide corner trim piece with improved locking features. It is a further object of the invention to provide corner trim pieces that have simulated cedar shake elements and that provide a natural looking fit and appearance with other corner trim pieces as well as laterally disposed siding panels having simulated cedar shake elements. These and other objects of the invention have been accomplished with the decorative corner trim members set forth and described below.

SUMMARY OF THE INVENTION

In one embodiment of the present invention, a corner trim member is provided for mounting on a wall surface in combination with decorative siding panels. The corner trim member includes a plurality of decorative elements integrally formed with the corner trim member and disposed in a vertical arrangement. The decorative elements define a front face of the corner trim member. The corner trim member may also include a top edge disposed above the decorative elements; a bottom end; a pair of side edges; and a longitudinally extending channel located adjacent each side edge for receiving a laterally disposed decorative siding panel. The longitudinally extending channels may be defined by a back surface of the side edges, an angled end wall extending from the back surfaces, and a mounting flange extending from the end walls. The angle between respective end walls and back surfaces may be an acute angle.

The acute angle may be approximately 45°.

The front face and the decorative elements may define a corner that is aligned with a corner of the wall surface that the corner trim member is mounted on. The corner trim member may further include a tab extending down from the bottom end. The tab may include a corner that is generally aligned with the corner defined by the front face. The mounting flanges may be disposed on opposite sides of the corner defined by the front face and portions of the tab on either side of the tab corner are generally parallel to the respective mounting flanges.

The mounting flanges may also include a lower segment that extends below the decorative elements. The lower segments of the mounting flanges may extend below the decorative elements to form a pocket in conjunction with the tab.

The mounting flanges may include upper segments that extend above the decorative elements. The upper segments of the mounting flanges extending above the decorative elements may be thinner than the central portion of the mounting flanges. Each of the mounting flanges may include a lower segment of reduced thickness adjacent the bottom end of the corner trim member, and the length of the lower segments may be approximately the same as the length of the upper segments so that when the corner trim member is mounted to the wall surface above a similar corner trim member, the upper and lower segments overlap with a combined thickness of the overlapped segments being approximately the same thickness as the central portion of the mounting flanges.

In another embodiment of the present invention, corner trim members are provided for mounting on a wall surface in combination with decorative siding panels, wherein the corner trim members each include at least one decorative element integrally formed in the corner trim members that defines a front face thereof. The corner trim members may also include a top edge disposed at the upper end of the corner trim members; a bottom end; a pair of side edges; and a mounting flange extending longitudinally along each side edge. The mounting flanges may include lower segments that extend below the decorative elements.

The corner trim members may further include a tab extending down from the bottom end. The tabs may include a corner that is generally aligned with a corner defined by the front face.

The lower segments of the mounting flanges may be thinner than a central portion of the mounting flanges. The mounting flanges may include upper segments that extend above the decorative elements, and the upper segments may also be thinner than the central portion of the mounting flanges. The corner trim members may be configured to mount in a vertical arrangement wherein the upper segments of a lower corner trim member are configured to be overlapped by the lower segments of the corner trim member mounted directly above, and wherein the combined overlapped thickness of the lower segments and the upper segments is approximately the same thickness as the central portions of the mounting flanges.

In another embodiment of the invention, a corner trim member is provided for mounting on a wall surface in combination with decorative siding panels wherein the corner trim member includes at least one decorative element integrally formed in the corner trim member that defines a front face thereof; a top edge disposed above the decorative element; a bottom end; a pair of side edges; and a longitudinally extending channel located adjacent each side edge for receiving a laterally disposed decorative siding panel. The longitudinally extending channels may be defined by an end wall extending from a back surface of the corner trim members and a mounting flange. The mounting flange may include an upper segment extending above the top edge.

The mounting flange may further include a lower segment that extends below the bottom end. The lower segments and the upper segments may be configured to overlap with respective upper segments and lower segments of vertically adjacent corner trim members, and the upper and lower segments are thinner than a central portion of the mounting flanges.

The end wall may be formed at an acute angle to the back surface.

In yet another embodiment of the invention, a corner trim member is provided for mounting on a wall surface in combination with decorative siding panels wherein the corner trim member includes at least one decorative element integrally formed in the corner trim member that defines a front face thereof; a top edge disposed above said decorative element; a bottom end; a pair of side edges; and a tab extending from the bottom end below the decorative element.

The corner trim member may further include a mounting flange having an upper segment and a lower segment extending above and below the decorative element, respectively.

The corner trim member may include a plurality of decorative elements disposed in a vertical arrangement.

The tab of the corner trim member may include a corner that is generally aligned with a corner defined by the front face.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
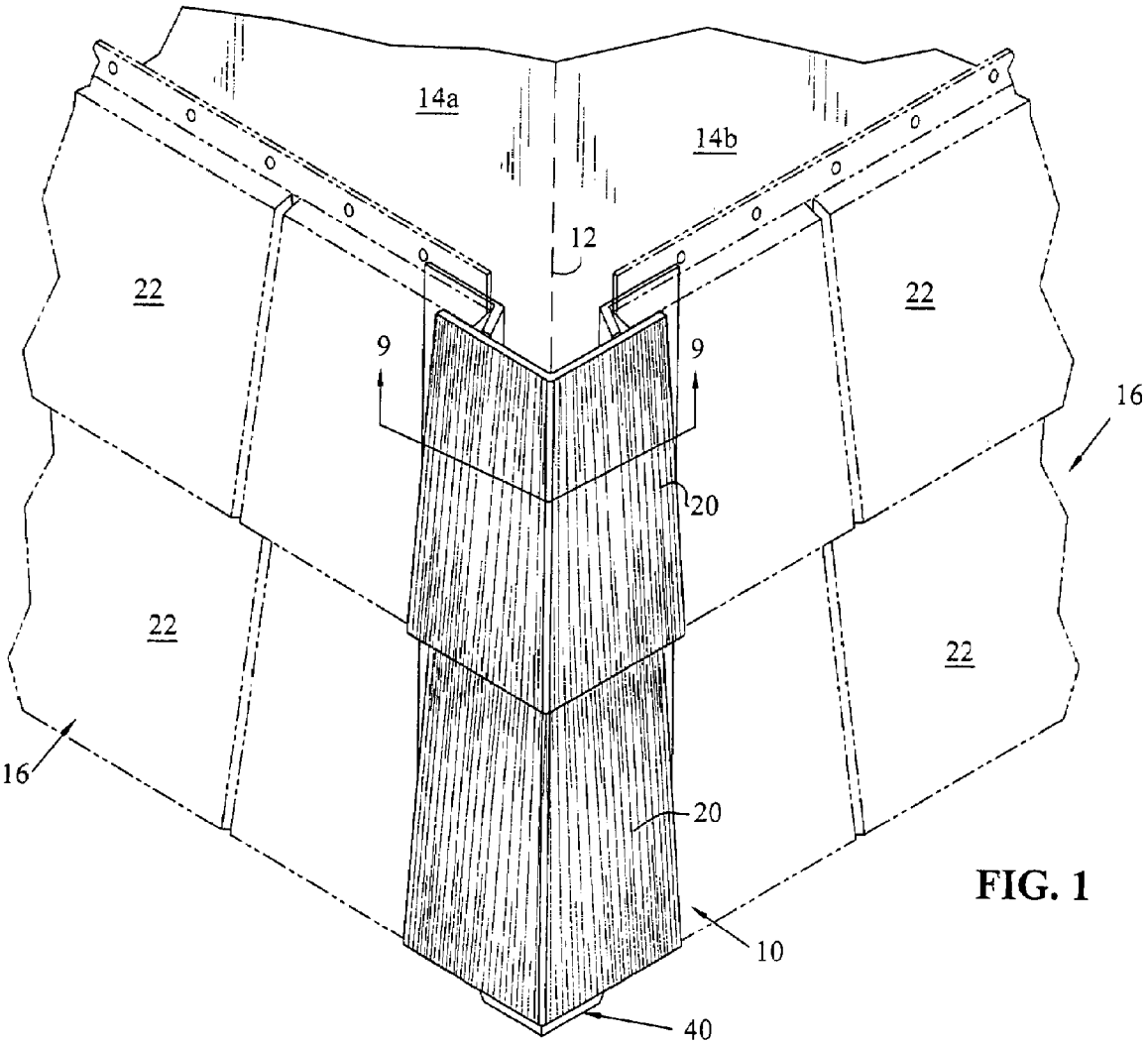
FIG. 1 is a perspective view of a corner trim member of the present invention shown disposed on the corner of a structure in combination with laterally adjoining decorative siding panels.
Figure 2:
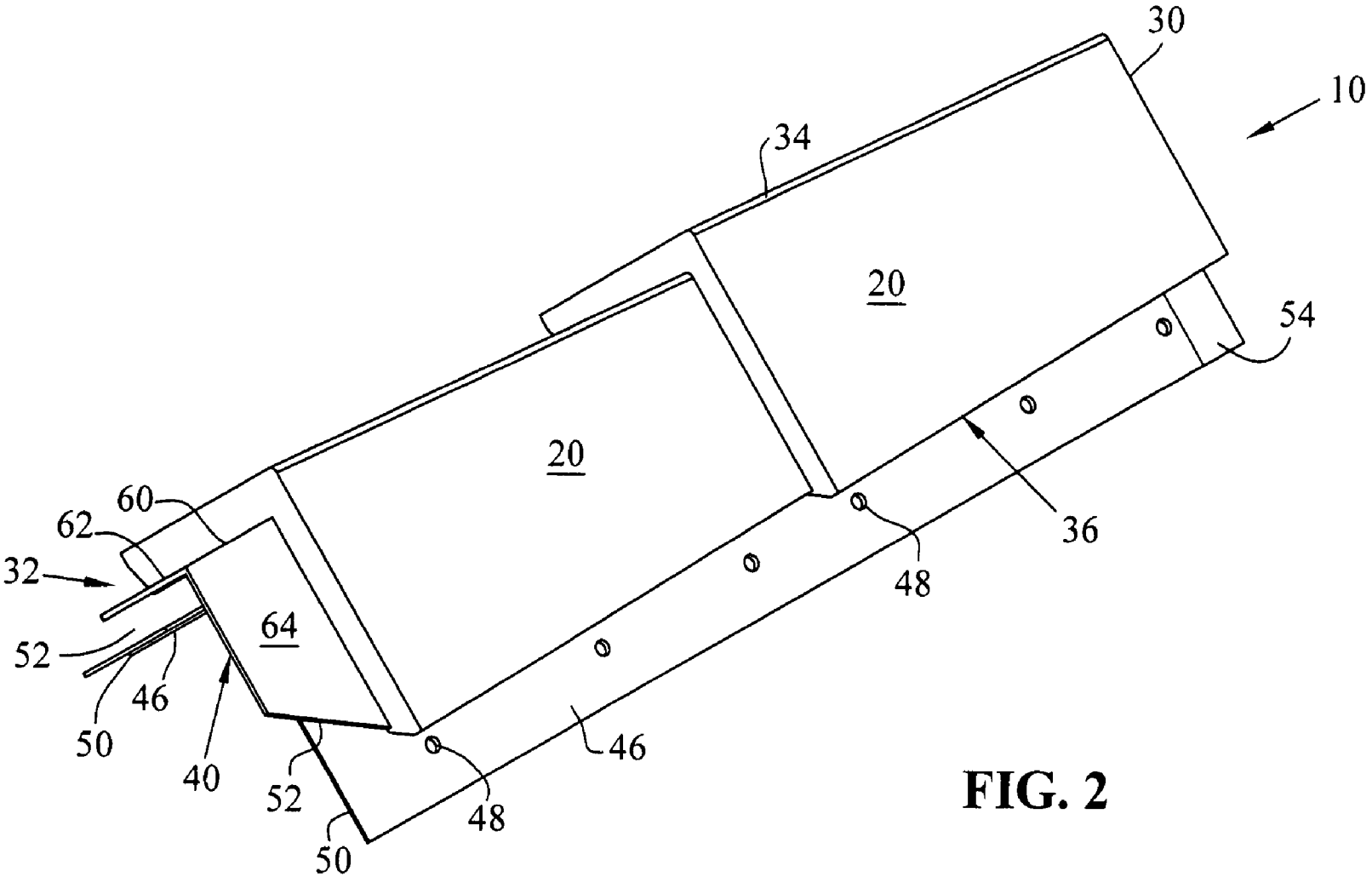
FIG. 2 is a perspective view from the bottom end of the corner trim member with the trim member removed from the structure and decorative siding panels.
Figure 3:
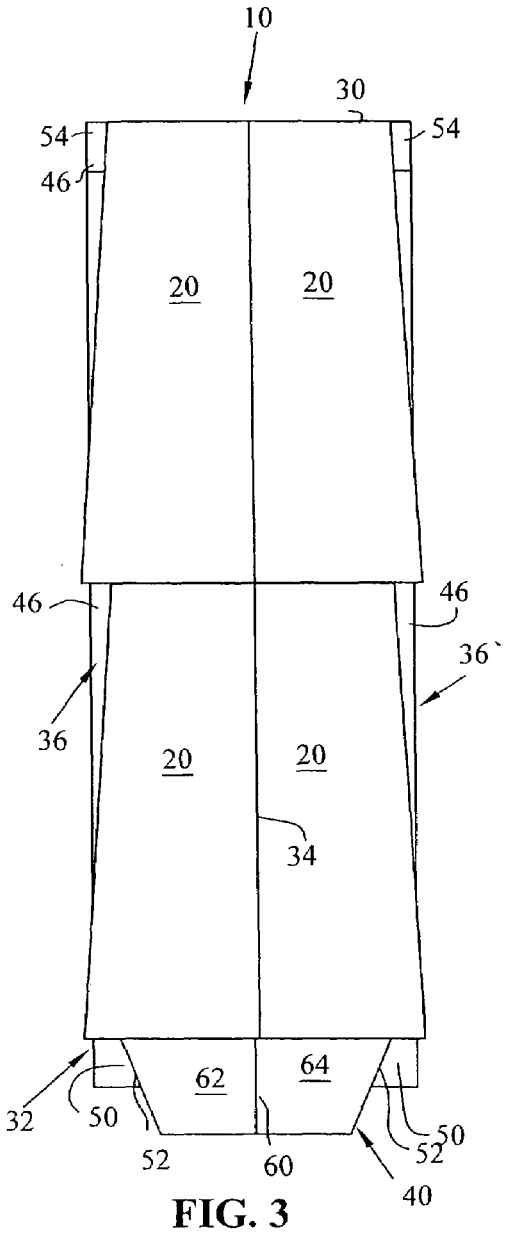
FIG. 3 is a front plan view of the corner trim member.
Figure 4:
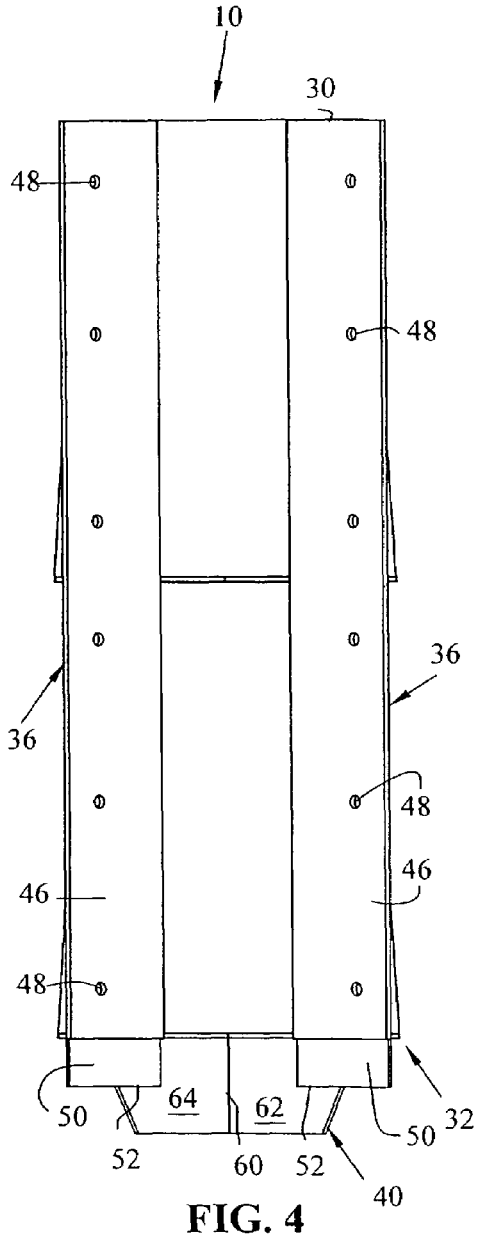
FIG. 4 is a rear plan view of the corner trim member.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in certain forms, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings and described below. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention provides corner trim members for use with decorative exterior wall coverings. The corner trim members are designed for receiving the wall coverings on either side thereof and for fitting together in a vertical arrangement for providing a decorative corner appearance.

Referring now to FIG. 1, a front perspective view is shown of a corner trim member of the present invention generally indicated as 10. Corner trim member 10 is mounted over the top of and in alignment with a corner 12 formed where two walls 14*a*, 14*b* of a structure intersect. Covering walls 14*a*, 14*b* are decorative exterior siding panels or wall coverings generally indicated as 16.

In the embodiments shown, both corner trim member 10 and siding panel 16 have front faces that include decorative elements 20, 22, respectively. The decorative elements may take the form of simulated cedar shake siding, wood boards, bricks, stucco, stone or other known decorative siding. Corner trim member 10 and siding member 16 may be formed from a lightweight composite plastic material such as polypropylene or vinyl and be made by conventional extrusion molding, injection molding, impression molding or other thermoforming processes. In addition, other known siding material such as aluminum may also be used.

Figure 5:
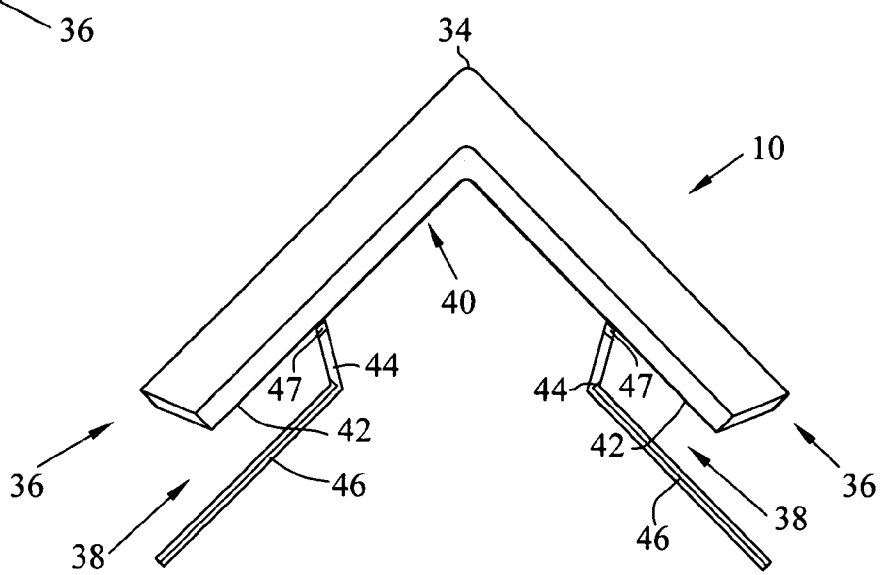
FIG. 5 is a top end view of the corner trim member.
Figure 6:
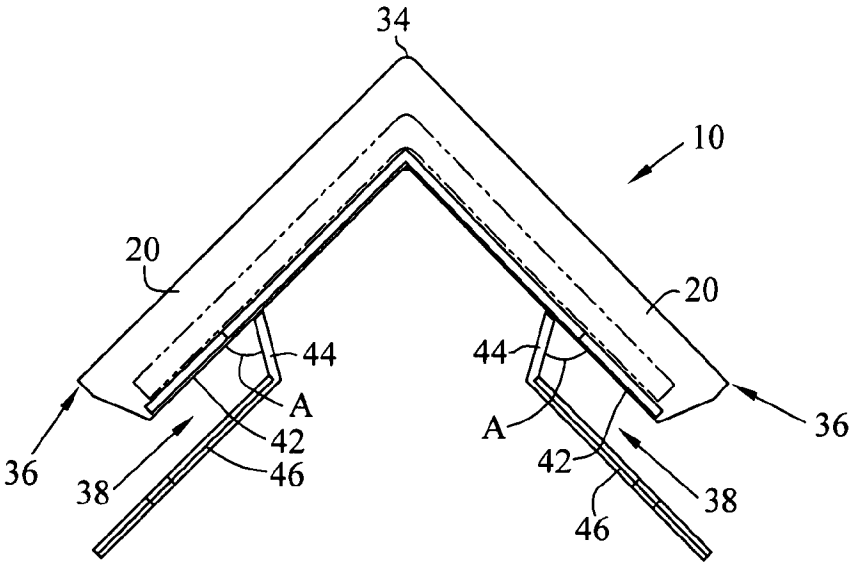
FIG. 6 is a bottom end view of the corner trim member.

Now referring to FIGS. 2-6, it can be seen that decorative elements 20 of corner trim member 10 are formed in a vertical arrangement. In the embodiment depicted, two rows of elements are shown; however, a single row or more than two rows of decorative elements may be used. Corner trim member 10 includes a top edge 30 disposed above decorative elements 20 and a bottom end generally indicated as 32. Corner trim member 10 also includes a corner 34 that coincides with corner 12 when mounted to walls 14*a*, 14*b*, a pair of side edges generally indicated as 36, and a longitudinally extending channel or groove adjacent each side edge generally indicated as 38 (as best shown in FIGS. 5 and 6). Corner trim member 10 also includes a tab generally indicated as 40 extending downward from bottom end 32.

Each of the longitudinally extending channels 38 are defined by a back surface 42 of corner trim members 10, an angled wall 44, and a mounting flange 46 extending from end wall 44 (as best shown in FIGS. 5 and 6). End wall 44 and back surface 42 define an angle A (FIG. 6) that may be an acute angle for reasons described below, and is a 45° angle in one embodiment. Located at the top of each end wall 44 is a slit 47 for receiving the tab 40 of the corner trim member mounted immediately above. The length of slits 47 is approximately as long or slightly longer than tabs 40. Mounting flanges 46 include mounting holes 48 for use in mounting corner trim member 10 to walls 14*a*, 14*b* using nails, screws, or other known fasteners (not shown). It should be appreciated that mounting holes 48 should be located near or to the outside of side edges 36 so as to be accessible for placement of the fasteners therethrough.

Additionally, mounting flanges 36 also include a lower segment 50 that extends below the bottom of decorative elements 20. Lower segments 50 may have a reduced and/or tapered thickness from the main portion of mounting flanges 46. Each lower segment 50 also forms a pocket 52 in conjunction with tabs 40. Mounting flanges 46 may also include upper segments 54 of reduced and/or tapered thickness that may be overlapped with lower segments 50 on a vertically adjacent corner trim member 10 located immediately thereabove when installed on walls 14*a*, 14*b*. In the embodiment shown, upper segments 54 have approximately the same length as lower segments 50.

Tab 40 includes a corner 60, and a pair of legs 62, 64 that intersect at corner 60 in a generally perpendicular manner. In the embodiment shown, legs 62 and 64 are approximately parallel with the respective lower segments 50 of mounting flanges 46 and are separated therefrom to form pocket 52.

To install a decorative wall covering including corner trim members 10 and sliding panels 16, typically, the assembly is started at the bottom of the structure and completed row by row until walls 14*a*, 14*b* are covered. Also, the siding panels 16 are typically first started and mounted at a left corner or junction and then the next panel is installed immediately adjacent to the right side of the first panel with connections that may be provided on the panels as is known. When the first row on wall 14*a* approaches an outside corner 12, a corner trim member is mounted at the corner using nails or fasteners in mounting holes 48. The siding panel 16 is then cut to appropriate length and mounted to wall 14*a* with the right end inserted into the respective longitudinal extending channel 38. The first row of the decorative siding panel 16 to cover wall 14*b* is then started by inserting the left end of the panel into the opposite longitudinally extending channel 38 and mounting the panel with nails or fasteners (not shown). The row is completed by installing the next and subsequent siding panels 16 to the right.

Figure 9:
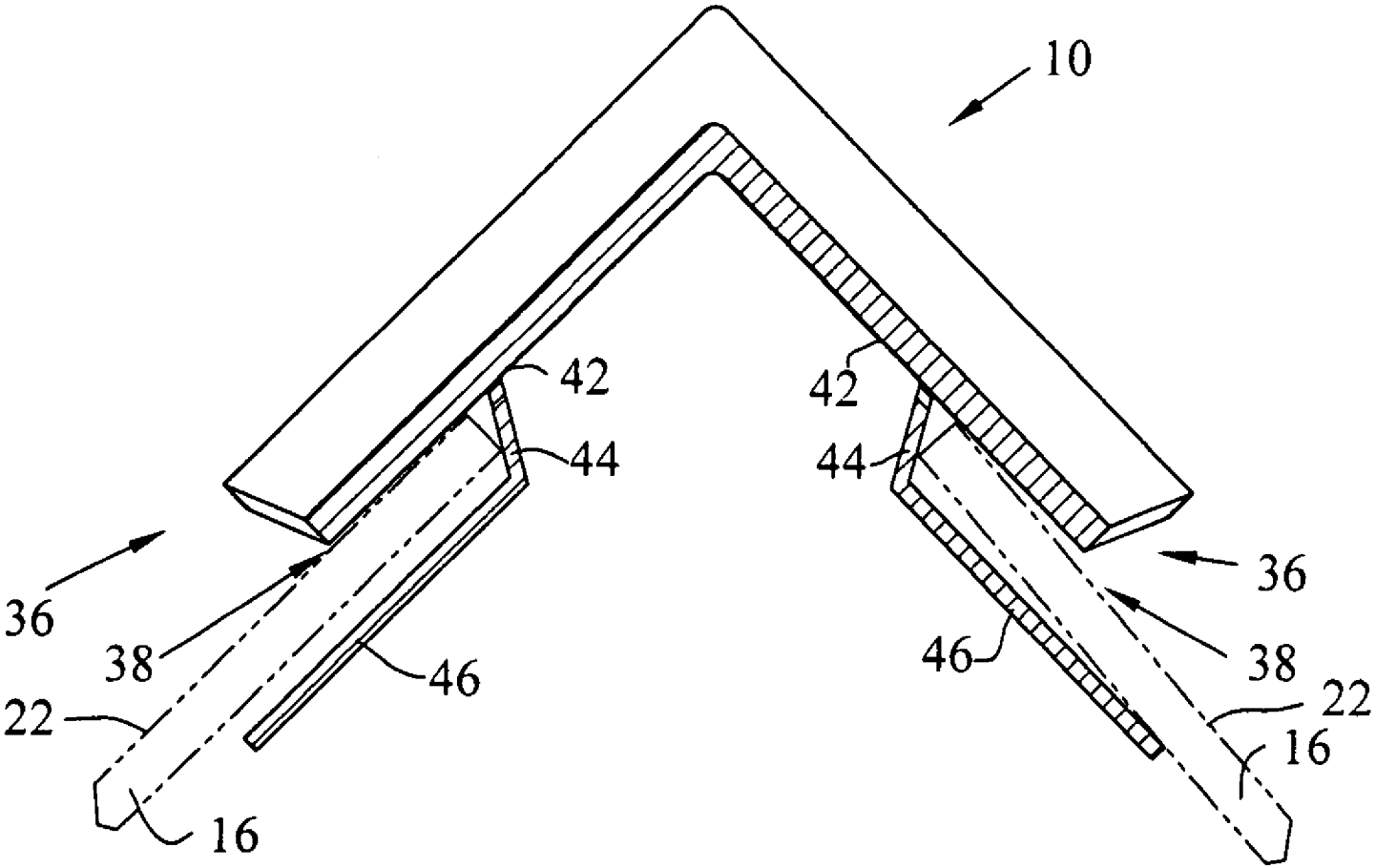
FIG. 9 is a cross-sectional view taken along line 9-9 of FIG. 1 showing the decorative siding panels disposed in side edge channels of the corner trim member.

Referring now to FIG. 9, it is shown how angled end walls 44 aid in improving the appearance and fit of corner trim member 10 with siding panels 16. In FIG. 9, siding panels 16 are shown inserted into longitudinally extending channels 38. Furthermore, the ends of the panels are fully inserted and abutting against respective angled end walls 44. Because of the acute angle A between end walls 44 and back surfaces 10, the ends of siding panels 16 are forced towards back surfaces 42. This reduces the gap and provides a better fit and appearance between the side edges 36 of corner trim member 10 and the front faces/decorative elements 22 of siding panels 16.

Figure 7:
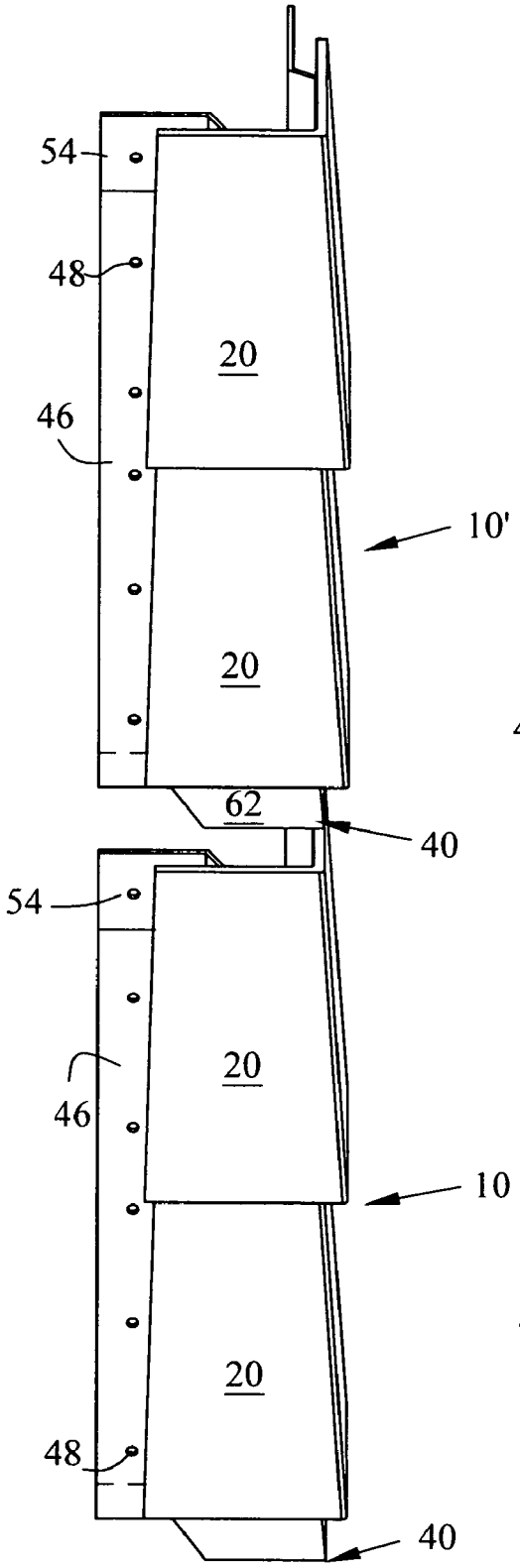
FIG. 7 is a perspective view showing two corner trim members ready to be fit together.
Figure 8:
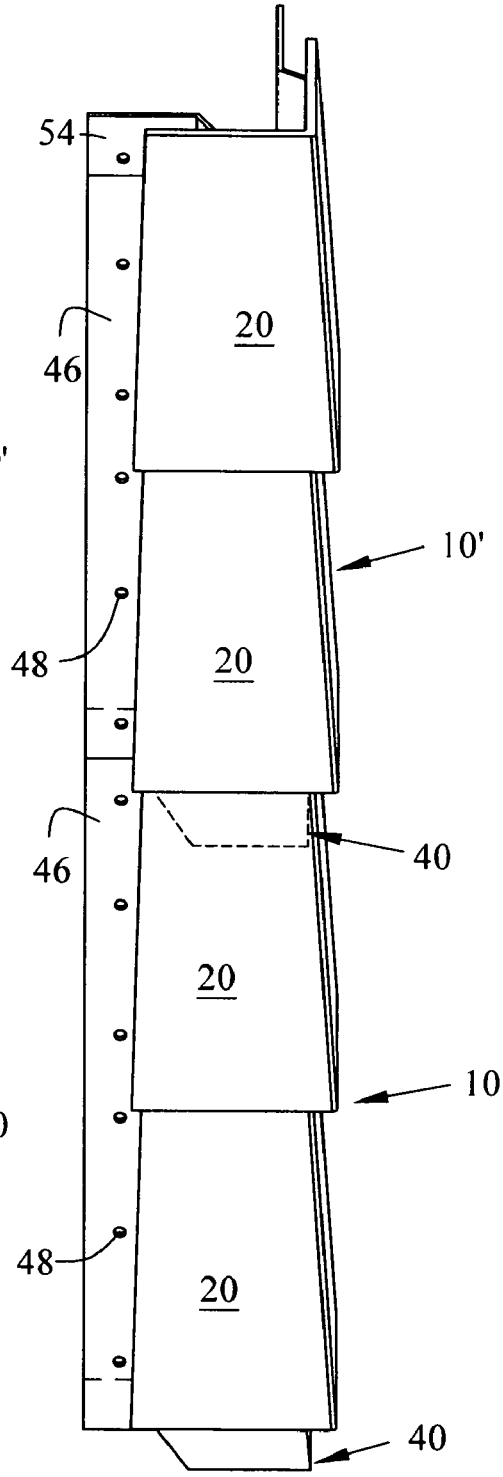
FIG. 8 is a perspective view of the corner trim members of FIG. 7 shown fit together.

Now referring to FIGS. 7 and 8, the installation of an upper vertically adjacent corner trim member 10' is shown. To install corner trim member 10', it is positioned above corner trim member 10 as shown in FIG. 7 and moved downward as shown by the arrows to the position in FIG. 8 wherein corner trim member 10' may then be mounted to walls 14*a*, 14*b* with nails or other fasteners through mounting holes 48. In this manner, reduced thickness lower segments 50 are overlapped on respective reduced thickness upper segments 54. The combined thickness of lower and upper segments 50, 54 may be approximately the same as the remainder of the thickness of mounting flange 46. Also, as corner trim member 10' is installed, its tab 40 is placed behind decorative elements 20 of corner trim member 10 and positioned in slits 47 of end walls 44. This results in a fit such that the joint between corner trim member 10' and corner trim member 10 is not readily visible when siding panels 16 are installed.

Figure 10:
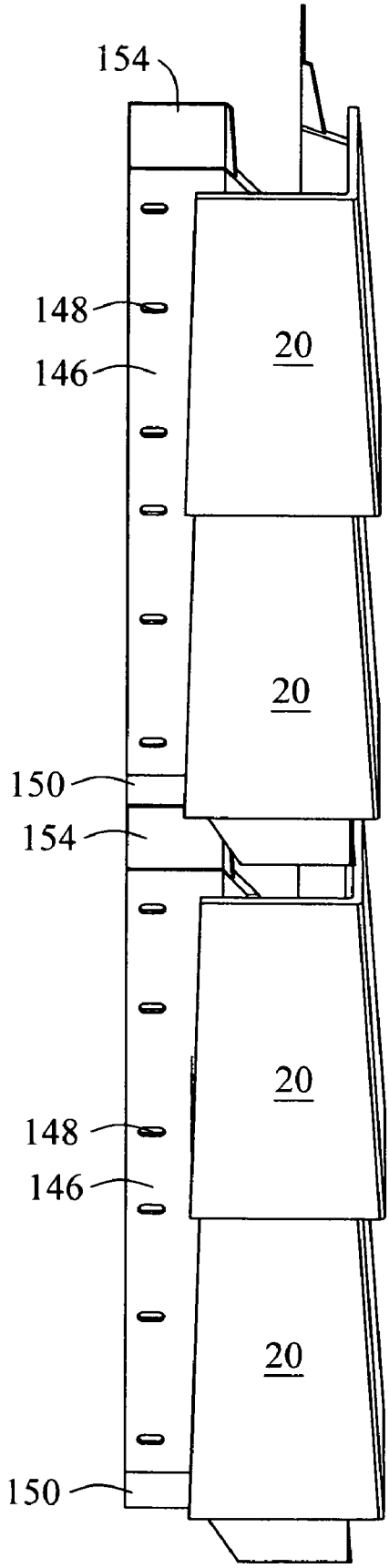
FIG. 10 is a perspective view of two corner trim members according to a second embodiment of the invention shown ready to be fit together.
Figure 11:
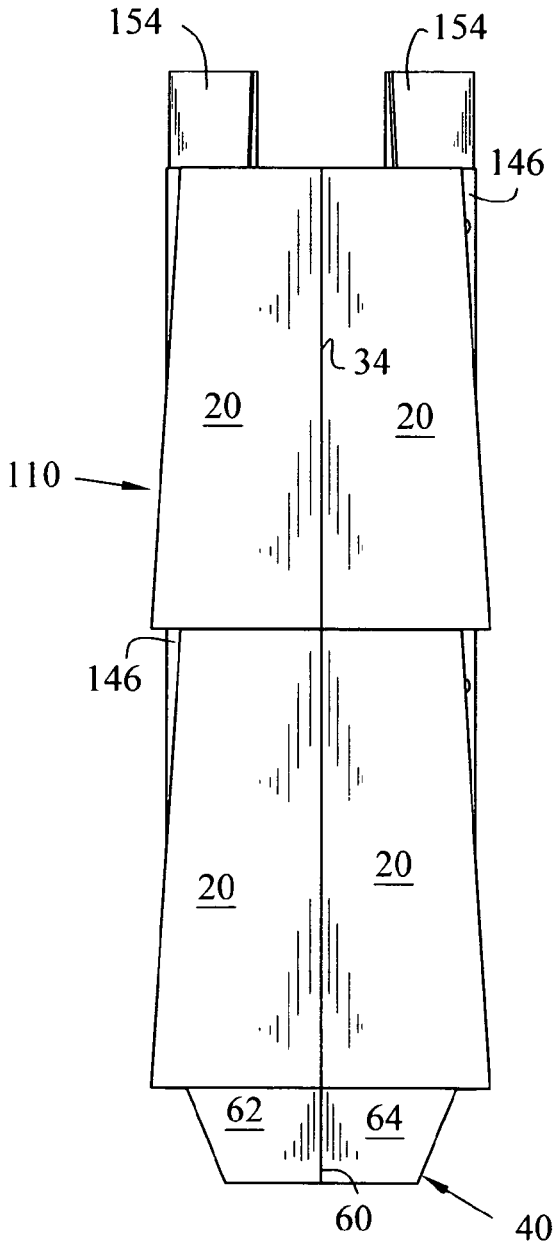
FIG. 11 is a front plan view of one of the corner trim members of the second embodiment.
Figure 12:
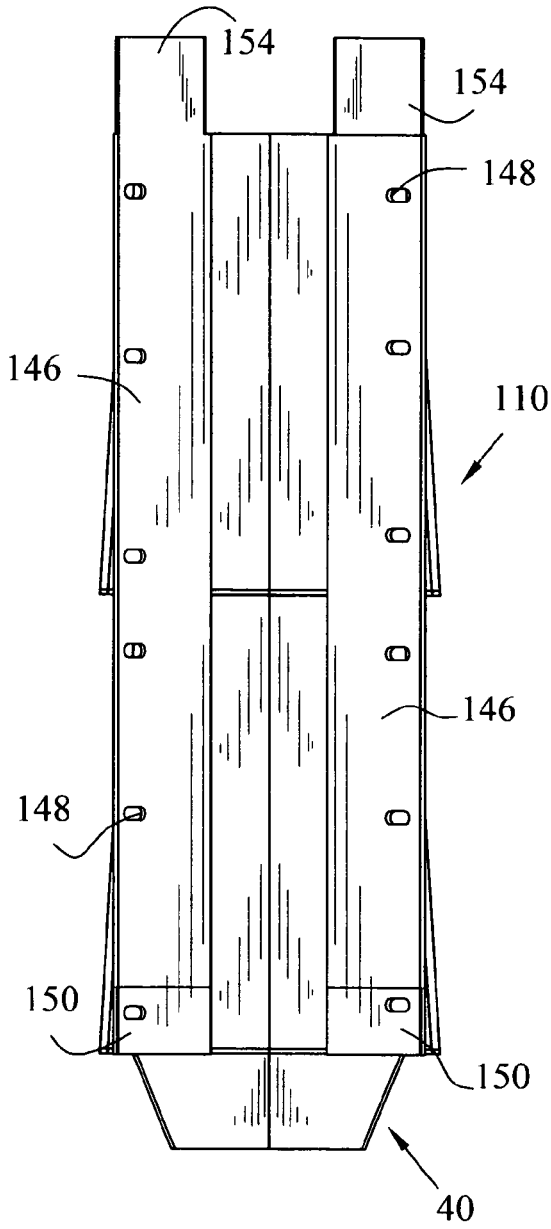
FIG. 12 is a rear plan view of one of the corner trim members of the second embodiment.

Another embodiment of the invention having corner trim members generally indicated as 110, 110' is shown in FIGS. 10-12. Corner trim members 110, 110' are similar to corner trim members 10, 10' except that corner trim members 110, 110' have modified mounting flanges 146. Mounting flanges 146 include horizontal mounting slots 148 instead of mounting holes 48. The mounting slots allow for some adjustment of the position of corner trim members 110, 110' when mounted to walls 14*a*, 14*b*. This aids in the installation of the corner trim members and adjacent decorative siding panels 16 and may improve the final fit and appearance. Mounting flanges 146 each include a lower segment 150 and an upper segment 154 having reduced and/or tapered thicknesses. In addition, lower segments 150 terminate approximate the lower end of decorative elements 20, while upper segments 154 extend above decorative elements 20. Corner trim members 110, 110' are installed in a manner similar to corner trim members 10 and 10'.

While the invention has been taught with specific reference to the above-described embodiments, one skilled in the art will recognize that changes can be made in form and detail without departing from the spirit and scope of the invention. For example, both upper and lower segments on the mounting flanges may extend above and below, respectively, the decorative elements. Other configurations or orientations may also be used for the mounting holes or slots in the mounting flanges, and the number of holes or slots may be varied as desired. In addition, the tab may be placed at the upper end of the corner trim members as opposed to the lower. The corner trim members may also be arranged such that the decorative elements 20 on opposite sides of corner 34 may be staggered from one another. Therefore, the scope of the invention is indicated by the following claims rather than by the description or figures.

What is claimed is:

1. A corner trim member for mounting on a wall surface in combination with decorative siding panels, said corner trim member comprising:

a plurality of decorative elements integrally formed in said corner trim member and disposed in a vertical arrangement, said decorative elements defining a front face of said corner trim member, said front face and said decorative elements define a corner that is aligned with a corner of the wall surface that said corner trim member is mounted on;

a top edge disposed above said decorative elements;

a bottom end;

a pair of side edges;

a longitudinally extending channel located adjacent each side edge for receiving a laterally disposed decorative siding panel, said longitudinally extending channels being defined by a back surface of the side edges, an angled end wall extending from said back surfaces, and a mounting flange extending from said end walls, the angle between respective end walls and back surfaces being an acute angle; and a tab extending down from said bottom end.

2. The corner trim member as set forth in claim 1, wherein the acute angle is approximately 45°.

3. The corner trim member as set forth in claim 1, wherein said tab includes a corner that is generally aligned with said corner defined by said front face.

4. The corner trim member as set forth in claim 3, wherein said mounting flanges are disposed on opposite sides of said corner defined by said front face, and portions of said tab on either side of said tab corner are generally parallel to the respective mounting flanges.

5. The corner trim member as set forth in claim 1, wherein each of said mounting flanges includes a lower segment that extends below said decorative elements.

6. The corner trim member as set forth in claim 5, wherein said lower segments of said mounting flanges extending below said decorative elements form a pocket in conjunction with said tab.

7. A corner trim member for mounting on a wall surface in combination with decorative siding panels, said corner trim member comprising:

a plurality of decorative elements integrally formed in said corner trim member and disposed in a vertical arrangement, said decorative elements defining a front face of said corner trim member;

a top edge disposed above said decorative elements;

a bottom end;

a pair of side edges; and a longitudinally extending channel located adjacent each side edge for receiving a laterally disposed decorative siding panel, said longitudinally extending channels being defined by a back surface of the side edges, an angled end wall extending from said back surfaces, and a mounting flange extending from said end walls, the angle between respective end walls and back surfaces being an acute angle, and wherein said mounting flanges include upper segments that extend above said decorative elements.

8. The corner trim member as set forth in claim 7, wherein said upper segments of said mounting flanges extending above said decorative elements are thinner than the central portion of said mounting flanges.

9. The corner trim member as set forth in claim 8, wherein each of said mounting flanges includes a lower segment of reduced thickness adjacent said bottom end of said corner trim member, and the length of said lower segments is approximately the same as the length of said upper segments so that when said corner trim member is mounted to the wall surface above a similar corner trim member, said upper and lower segments overlap and wherein the combined thickness of the overlapped segments is approximately the same thickness as the central portion of said mounting flanges.

10. Corner trim members for mounting on a wall surface in combination with decorative siding panels, said corner trim members each comprising:

at least one decorative element integrally formed in said corner trim members and defining a front face thereof;

a top edge disposed at the upper end of said corner trim members;

a bottom end;

a pair of side edges;

a mounting flange extending longitudinally along each side edge, said mounting flanges including lower segments that extend below a bottom edge of the decorative element on the corner trim member to which it is attached;

a tab extending down from said bottom end; and an end wall extending from a back surface of the side edges and a slit provided at the top end of each end wall and wherein said tab includes a corner that is generally aligned with a corner defined by said front face, and the tab of an upper corner trim member is received in the slits in the end walls adjacent the back surface of a lower corner trim member.

11. Corner trim members for mounting on a wall surface in combination with decorative siding panels, said corner trim members each comprising:

at least one decorative element integrally formed in said corner trim members and defining a front face thereof;

a top edge disposed at the upper end of said corner trim members;

a bottom end;

a pair of side edges; and a mounting flange extending longitudinally along each side edge, said mounting flanges including lower segments that extend below a bottom edge of the decorative element on the corner trim member to which it is attached, and wherein said lower segments of said mounting flanges are thinner than a central portion of said mounting flanges, and said mounting flanges extend from end walls, said end walls extending from the back surface of the side edges.

12. The corner trim members as set forth in claim 11, wherein said mounting flanges include upper segments that extend above said decorative elements.

13. The corner trim members as set forth in claim 12, wherein said upper segments are thinner than said central portion of said mounting flanges.

14. The corner trim members as set forth in claim 13, being configured to mount in a vertical arrangement wherein said upper segments of a lower corner trim member are configured to be overlapped by the lower segments of the corner trim member mounted directly above, and wherein the combined overlapped thickness of said lower segments and said upper segments is approximately the same thickness as said central portions of said mounting flanges.

15. A corner trim member for mounting on a wall surface in combination with decorative siding panels, said corner trim member comprising:

at least one decorative element integrally formed in said corner trim member and defining a front face thereof;

a top edge disposed above said decorative element;

a bottom end located at the lowest edge below the decorative element on the corner trim member;

a pair of side edges; and a longitudinally extending channel located adjacent each side edge for receiving a laterally disposed decorative siding panel, said longitudinally extending channels defined by an end wall extending from a back surface of said corner trim members and a mounting flange, said mounting flange including an upper segment extending above said top edge and a lower segment extending below said bottom end, and wherein said lower segments and said upper segments are configured to overlap with respective upper segments and lower segments of vertically adjacent corner trim members, and said upper and lower segments are thinner than a central portion of said mounting flanges.

16. A corner trim member for mounting on a wall surface in combination with decorative siding panels, said corner trim member comprising:

at least one decorative element integrally formed in said corner trim member and defining a front face thereof;

a top edge disposed above said decorative element;

a bottom end located at the lowest edge below the decorative element on the corner trim member;

a pair of side edges; and a longitudinally extending channel located adjacent each side edge for receiving a laterally disposed decorative siding panel, said longitudinally extending channels defined by an end wall extending from a back surface of said corner trim members, said end wall is formed at an acute angle to said back surface, and a mounting flange, said mounting flange including an upper segment extending above said top edge and a lower segment extending below said bottom, and wherein said end wall is formed at an acute angle to said back surface.

17. A corner trim member for mounting on a wall surface in combination with decorative siding panels, said corner trim member comprising:

a plurality of decorative elements integrally formed in said corner trim member and disposed in a vertical arrangement, said decorative elements defining a front face of said corner trim member;

a top edge disposed above said decorative elements;

a bottom end;

a pair of side edges;

a longitudinally extending channel located adjacent each side edge for receiving a laterally disposed decorative siding panel, said longitudinally extending channels being defined by a back surface of the side edges, an angled end wall extending from said back surfaces, and a mounting flange extending from said end walls, the angle between respective end walls and back surfaces being an acute angle, said mounting flanges including a lower segment that extends below a bottom edge of the lowest one of said decorative elements; and a tab extending down from said bottom end.

18. The corner trim member as set forth in claim 17, further including a slit between said angled end wall and said back surfaces configured to receive the tab of another corner trim member mounted above and wherein said lower segments of said mounting flanges extending below said decorative elements form a pocket in conjunction with said tab.

* * * * *

UNITED STATES PATENT AND TRADEMARK OFFICE

CERTIFICATE OF CORRECTION

PATENT NO. : 7,654,050 B2
APPLICATION NO. : 10/852993
DATED : February 2, 2010
INVENTOR(S) : Brett C Justice It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1367 days.

Signed and Sealed this

Twenty-third Day of November, 2010

David J. Kappos

David J. Kappos
*Director of the United States Patent and Trademark Office*